US007353744B2

(12) United States Patent
Dixen et al.

(10) Patent No.: US 7,353,744 B2
(45) Date of Patent: Apr. 8, 2008

(54) HYDRAULIC CONTROL

(75) Inventors: Carl Christian Dixen, Sydals (DK); Knud Meldgaard Jensen, Augustenborg (DK); Steen Slot, Soenderborg (DK); Svend Giversen, Soenderborg (DK); Svend Erik Thomsen, Nordborg (DK); Smari Johannsson, Mosfellsbaer (IS)

(73) Assignee: Sauer-Danfoss Aps, Nordborg (DK)

( * ) Notice: Subject to any disclaimer, the term of this patent is extended or adjusted under 35 U.S.C. 154(b) by 166 days.

(21) Appl. No.: 11/315,705

(22) Filed: Dec. 21, 2005

(65) Prior Publication Data

US 2006/0156914 A1 Jul. 20, 2006

(30) Foreign Application Priority Data

Dec. 22, 2004 (DE) ..... 10 2004 063 044

(51) Int. Cl.
*F15B 13/04* (2006.01)

(52) U.S. Cl. ..... 91/446; 91/448

(58) Field of Classification Search ..... 60/464; 91/444, 446, 448

See application file for complete search history.

(56) References Cited

U.S. PATENT DOCUMENTS

| | | | | |
|---|---|---|---|---|
| 4,685,295 A | | 8/1987 | Christiansen et al. | 60/459 |
| 4,782,859 A | | 11/1988 | Constantinian | 137/596.2 |
| 4,972,761 A | | 11/1990 | Thomsen | 91/420 |
| 4,981,159 A | | 1/1991 | Christensen et al. | 137/625.69 |
| 5,415,076 A | | 5/1995 | Krone et al. | 91/421 |
| 5,660,096 A | * | 8/1997 | Friedrichsen | 91/446 |
| 6,865,886 B2 | | 3/2005 | Jensen et al. | 60/46 |

FOREIGN PATENT DOCUMENTS

| | | |
|---|---|---|
| DE | 38 00 188 A1 | 7/1989 |
| DE | 38 02 672 A1 | 8/1989 |
| DE | 198 00 721 A1 | 7/1999 |
| DE | 102 16 958 B3 | 4/2002 |
| EP | 1 045 992 B1 | 11/2004 |

* cited by examiner

*Primary Examiner*—Michael Leslie
(74) *Attorney, Agent, or Firm*—McCormick, Paulding & Huber LLP

(57) ABSTRACT

The invention concerns a hydraulic control (1) with a supply connection arrangement (7) having a high-pressure connection (P) and a low-pressure connection (T), a working connection arrangement having two working connections (A, B) connectable with a consumer, a control valve (8) with a valve element (9) between the supply connection arrangement and the working connection arrangement and a compensation valve (11), which is located between the high-pressure connection (P) and the control valve (8) and is acted upon in the closing direction by a pressure between the compensation valve (11) and the control valve (8).

It is endeavoured to ensure the most favourable energy consumption possible.

For this purpose, in the opening direction the compensation valve (11) is acted upon by a pressure of a selection device (29, 30, 30', 38), which optionally supplies the compensation valve (11) with a pressure control pressure or a flow control pressure.

18 Claims, 6 Drawing Sheets

Fig.1
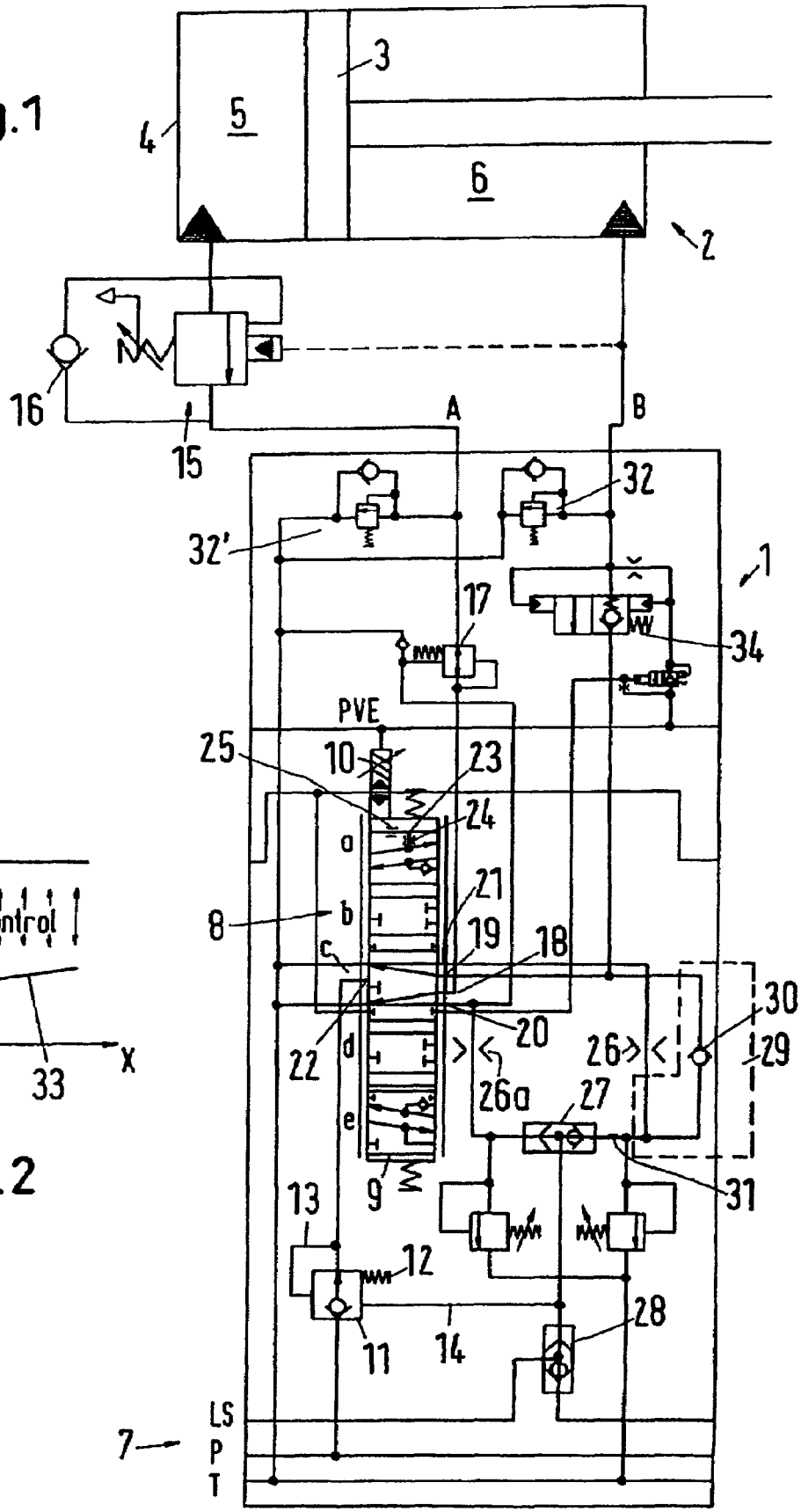
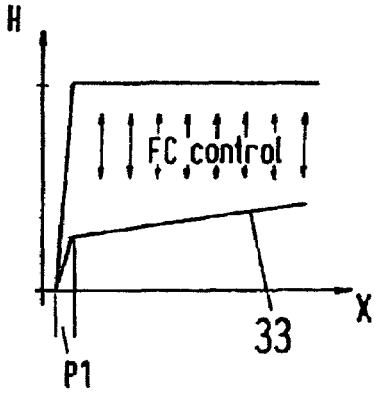
Fig.2

HYDRAULIC CONTROL

CROSS-REFERENCE TO RELATED APPLICATIONS

Applicant hereby claims foreign priority benefits under U.S.C. § 119 from German Patent Application No. 10 2004 063 044.5 filed on Dec. 22, 2004, the contents of which are incorporated by reference herein.

FIELD OF THE INVENTION

The invention concerns a hydraulic control with a supply connection arrangement having a high-pressure connection and a low-pressure connection, a working connection arrangement having two working connections connectable with a consumer, a control valve with a valve element between the supply connection arrangement and the working connection arrangement and a compensation valve, which is located between the high-pressure connection and the control valve and is acted upon in the closing direction by a pressure between the compensation valve and the control valve. Further, the invention concerns a method of controlling a hydraulic consumer, which is controlled by a control valve in a pressure control operation mode.

BACKGROUND OF THE INVENTION

Such a hydraulic control and such a method are known from DE 198 00 721 A1. In the opening direction, the compensation valve is acted upon by a spring and a pressure, which can be supplied via a fixed throttle. The fixed throttle is part of a pressure divider between the outlet of the compensation valve and the low-pressure connection, which here is a tank connection. Thus, the compensation valve ensures a pressure control, in which the motor inlet pressure has a value, which is substantially determined by the position of the control valve.

In the return pipe from the motor to the low-pressure connection, a compensation valve and a load-retaining valve are arranged in series. Via a pilot pipe the load-retaining valve is supplied with the motor inlet pressure in the opening direction and via a further pilot pipe with the pressure at the outlet of the load-retaining valve. Thus, under the influence of a spring, the load-retaining valve adjusts so that it does not open until the pressure difference has overcome the spring force.

When, now, this motor is lowered under a load, a relatively high inlet pressure is required. For example, the control valve slide has to be opened relatively much, and, in dependence of the design, a larger or smaller slide movement is required to control the high pressure. This is energetically unfavourable, as this high pressure merely has to be available for opening the load-retaining valve.

Another possibility of using the compensation valve is shown in DE 102 16 958 B3. Here, the compensation valve is controlled by a pressure difference over the control valve and keeps the pressure difference over the control valve constant. In this manner, a flow control is realised, in which the amount supplied to the consumer depends on the position of the valve element. The more the valve element is displaced, the larger are the inlet flow and the outlet flow.

U.S. Pat. No. 4,981,159 shows a hydraulic control, which can be used with different valve elements as pressure control on the one side and as flow control on the other side. For this purpose, the valve element, which also has the form of a slide, merely has to be replaced. In principle, such a replacement is not difficult. However, it can only be made, when the system is pressureless or, even better, empty. Thus, a change of operation modes still requires certain efforts.

BRIEF SUMMARY OF THE INVENTION

The invention is based on the task of providing the most favourably energy consumption pattern.

With a hydraulic control as mentioned in the introduction, this task is solved in that in the opening direction the compensation valve is acted upon by a pressure of a selection device, which optionally supplies the compensation valve with a pressure control pressure or a flow control pressure.

With this embodiment, it is possible to operate the hydraulic control optionally in a pressure control operation mode or a flow control operation mode. It is not necessary to make any alteration. It is sufficient to use different pressures, which are selected via the selection device and then specifically supplied to the compensation valve. Thus, it is possible to select the pressure control pressure or flow control pressure, which permits the most favourable energetic operation mode. The selection device can be provided for both movement directions of the consumer. In many case, however, it will be sufficient to provide the selection device for only one movement direction, in which negative loads can occur. Further, with this embodiment, a substantially more comfortable operation of the control, can be achieved. When, until now, it has been desired to lower a negative load, for example to collapse a crane jib, first a negative load and then a positive load had to be supplied to ensure a complete collapse of the crane jib. For this purpose, an actuating element of the control had to be moved to manage the transition from the negative to the positive load. With the new embodiment, the actuating element, for example a handle, can be left in a set position, and the control will automatically change to flow control, when the force gets positive.

It is preferred that the selection device supplies the higher of the pressures, pressure control pressure and flow control pressure, to the compensation valve. This has two advantages. Firstly, it is easier to decide, which of the two pressures should be chosen. Secondly, also the operation of the selection device can be automated in this manner.

Preferably, an actuation of the control valve from a predetermined position will make the selection device pass on firstly the pressure control pressure and secondly the flow control pressure to the compensation valve. The position mentioned can, for example, be a "zero position" or "neutral position", which is used as an example in the following explanation. Depending on the design of the control valve, this predetermined position can, however, also be somewhere else. When the control valve is moved from its zero position, it opens increasingly and thus passes on hydraulic fluid from the high-pressure connection, which is usually made as pump connection, to a working connection. In the initial phase of this opening section, the control is then operated in a pressure control operation mode, in which the pressure at the outlet of the control valve substantially depends on the position of the valve element of the control valve. Of course, the individual pressures depend on the exact design of the valve element, for example a valve slide. Thus, here the explanation has to be understood as an example. It merely serves a better understanding of the invention. This pressure can then, for example, be used to open other valves of the control, for example a load-retaining valve. This load retaining valve then merely has to be dimensioned for this relatively small pressure, which is enabled by the pressure control. It is also possible to act oppositely and first select a load-retaining valve and then dimension the remaining system. When this minimum pressure is exceeded, the selection device automatically switches to a flow control operation mode. In a flow control operation mode the pressure is then determined practically exclusively by the consumer, that is, only the absolutely necessary pressure is provided. The control valve, which is preferably a proportional valve, then supplies the corresponding amount of hydraulic fluid, that is, to put it simply, it controls the speed, with which the consumer is driven. Thus, with this embodiment the energetically most favourable pressure, that is, the pressure required by the consumer, is set in a pressure area, which is limited downwards by the minimum pressure specified by the pressure control and upwards, if required, by an overpressure valve. Thus, in the end, the external conditions determine the form of control to be active. Of course, this also applies in the "initial phase".

Preferably, the selection device is on the one side connected with a working pipe located between the control valve and a working connection and on the other side with a control pipe connected with a load-sensing pipe. Of course, this applies, when the control valve is in the operation state, that is, the valve element has been deflected from its resting position and has created a connection between the compensation valve and one of the working connections. The actuation of the valve element increases the pressure in the working pipe. As long as this pressure is smaller than the pressure in the control pipe, a pressure control occurs. During the pressure control, the pressure at the working connection is substantially depending on the position of the valve element. If the valve element is further activated, the pressure at the working connection will, depending on the external conditions, at some time exceed the pressure in the control pipe. In this case, a flow control occurs, in which the pressure at the working connection is determined by the pressure of the consumer. Thus, an energetically extremely favourable operation can be realised, as only the pressure required to drive the consumer has to be supplied. In the control pipe there is, in a manner of speaking, an "artificial load signal".

Preferably, the control pipe is connected with an outlet of a pressure divider, which is located between the compensation valve and the low-pressure connection. The same pressure divider can also be used to generate the load-sensing signal. However, usually a further throttle is located between the pressure divider and a load-sensing connection (LS connection), which throttle causes a certain decoupling. The outlet of the pressure divider supplies a pressure, which acts upon the compensation valve in the opening direction. This is a relatively simple manner of providing the pressure control.

Preferably, the pressure divider has at least two throttles, of which one can be adjusted by the valve element of the control valve. This throttle is usually the throttle located between the outlet and the low-pressure connection.

In a preferred embodiment, the pressure divider has two throttles, which can both be adjusted by the valve element of the control valve. When the throttles of the pressure divider have a constant value, the pressure at the outlet of the control valve remains substantially constant in the pressure control area. When these throttles have a variable value, the pressure can be increased or reduced.

In a preferred embodiment, the selection device has a non-return valve, which opens in the direction of the compensation valve. This is a relatively simple embodiment, which is, however, sufficient, when merely the higher of the two pressures has to be passed on to the compensation valve.

It is preferred that the non-return valve is located in the valve element of the control valve. In this case only few modifications of the control itself are required. Merely a small modification in the valve element of the control valve is required.

The selection device can also comprise a shuttle valve. In a manner of speaking, a shuttle valve is a non-return valve with two non-return valve functions. Also such a shuttle valve can be located in the valve element of the control valve.

Preferably, a load-retaining valve is located at least one working connection, which load retaining valve can be opened by the pressure at the other working connection. Such a load-retaining valve is also called "overcenter" valve. A predetermined opening pressure is required for such a load-retaining valve. This opening pressure cannot be made too small, to prevent the load-retaining valve from opening unintentionally, when leakages or other unfavourable conditions lead to a pressure build-up, which causes the opening of the load-retaining valve. With a pilot control device, the opening pressure of the load-retaining valve can now be kept relatively high, thus keeping the required safety distance to pressures building up parasitically without having to drive the energetic efforts for opening the load-retaining valve too high. To open the load-retaining valve, a pressure merely has to be built up at the other working connection, which is sufficient to activate the pilot control device. Such a pressure can, for example, correspond to the minimum pressure specified by the pressure control. Thus, to lower a load only the absolutely necessary pressure has to be built up. This pressure can, for example, correspond to the pressure of the opening spring at the compensation valve plus the pressure at the outlet of the pressure divider before the control valve. Of course, in another such embodiment it is also possible to use a return compensation valve between the consumer or the working connection and the control valve.

It is preferred that the pilot control device has a pilot valve element controllable by the pressure at the other working connection, said pilot control device making in the controlled state a connection from one working connection to a control inlet of the load-retaining valve and interrupting it in the uncontrolled state. This is a relatively simple design of a pilot control device.

Preferably, the working connection arrangement is connected with an anti-cavitation device, which has an anti-cavitation valve with an anti-cavitation valve element, which is displaceable by means of a pressure at a working connection and creates a connection between a consumer connection and the other working connection. The connection can be realised in that in the direction of the consumer practically no restrictions exist in the form of throttles, narrow passages in a valve block or the like. Accordingly, the refilling can take place at a lower pressure than before, so that also a pushing operation, that is, an operation with negative loads, will also require relatively less additional energy.

Preferably, the outlet of the selection device is connected with a pressure limitation valve. Via the pressure limitation valve, which is set in dependence of the application, for example, the pressure control pressure can be increased or decreased with the change of position of the valve element of the control valve.

The task is solved with a method as mentioned in the introduction in that the control valve alternatively controls the consumer in a flow control operation mode and that the switching between the pressure control operation mode and the flow control mode occurs automatically in dependence of the ruling pressures.

Thus, it is possible to operate the consumer in an energetically favourable area. In the flow control operation mode the pressure of the consumer is determining. In the pressure control operation mode the pressure of the control valve is determining. The switching between these two operation modes then depends on the pressures at the consumer connection. For example, the selection device mentioned above can be used for this purpose. However, such a method can also be realised otherwise, for example with electrically controlled components.

BRIEF DESCRIPTION OF THE DRAWINGS

In the following, the invention is described by means of preferred embodiments in connection with the drawings, showing:

FIG. 1 a first embodiment of a hydraulic control;

FIG. 2 a schematic view explaining the pressure conditions;

DETAILED DESCRIPTION OF THE INVENTION

Figure 3:
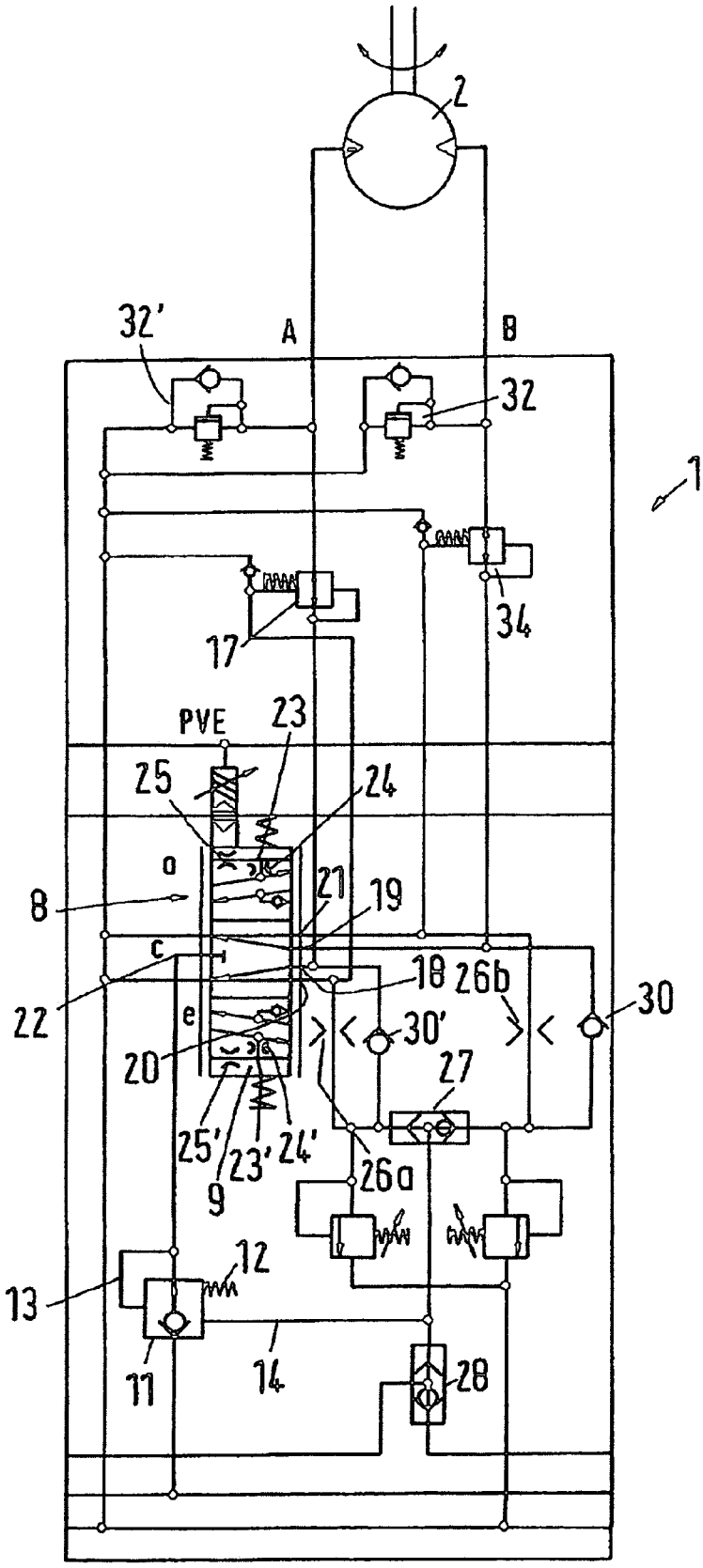
FIG. 3 a second embodiment of the hydraulic control.

FIG. 1 shows a hydraulic control 1 for the control of a consumer 2, here a piston cylinder arrangement with a piston 3 and a cylinder 4. The piston 3 divides the cylinder into a first pressure chamber 5 and a second pressure chamber 6. The two pressure chambers 5, 6 are connected with working connections A, B of the control 1. Together, the two working connections A, B form a working connection arrangement.

The control 1 has a supply connection arrangement 7, which has a high-pressure connection P in the form of a pump connection, a low-pressure connection T in the form of a tank connection and a load-sensing connection LS.

Between the supply connection arrangement 7 and the working connection arrangement A, B is located a control valve 8, which has a valve slide 9 as valve element. By means of a merely schematically shown actuator 10, for example in the form of an electromagnetic actuator or a pilot controlled actuator, the valve slide 9 can be displaced to a total of five different operation modes. These operation modes are shown by means of five positions a to e. Actually, however, the valve slide 9 of the control valve 8 is practically continuously movable, so that it can assume practically any intermediate position. Here, the control valve 8 is a proportional valve.

In a manner known per se and therefore not described in detail, the valve slide 9 has grooves and other recesses, if required bores and the like, on its circumference, which overlap corresponding annular grooves, recesses and bores in a housing of the control valve 8, thus releasing or blocking in a more or less throttled manner certain connections between the supply connection arrangement 7 and the working connection arrangement A, B in dependence of the position of the valve slide 9. Examples showing the housing of such control valves and a corresponding slide are, for example, known from U.S. Pat. No. 4,981,159 mentioned in the introduction. Depending on the requirements, a person skilled in the art will be able to make such a slide and a corresponding housing.

A compensation valve 11 is located between the control valve 8 and the high-pressure connection P. In the opening direction the compensation valve is loaded by the force of a spring 12 and the pressure in a control pipe 14. In the closing direction the compensation valve 11 is connected via a pipe 13 with its outlet, that is, a point between the compensation valve 11 and the control valve 8. Thus, in the closing direction the inlet pressure of the control valve 8 acts upon the compensation valve 11.

For reasons of simplicity the working connection A is in the following called "lifting connection", as through this connection hydraulic fluid is supplied to the larger pressure chamber 5, which leads to a lifting or extension of the piston 3. The working connection B, however, is called "lowering connection". Here pressurised hydraulic fluid must be supplied to lower or retract the piston 3 again. A load-retaining valve 15 is connected with the lifting connection A, which load-retaining valve 15 can be opened by the pressure at the lowering connection B. The load-retaining valve 15 is bridged by a non-return valve 16 opening in the direction of the first pressure chamber 5.

The lifting connection A is connected via a return compensation valve 17 with a first working outlet 18 of the control valve 8. The control valve 8 has a second working outlet 19, which is connected with the lowering connection B. When negative loads occur, the lifting connection A is controlled by the return compensation valve 17, as known from, for example DE 102 16 958 B3.

Further, the control valve 8 has a first load-sensing outlet 20 and a second load-sensing outlet 21. In the shown neutral position c of the valve element 9, the first working outlet 18, the second working outlet 19, the first load-sensing outlet 20 and the second load-sensing outlet 21 are connected with the low-pressure connection T. Thus, in a manner of speaking, the consumer 2 is in a "floating position".

Located next to the neutral position c are blocking positions b, d of the valve element 9, in which merely the two load sensing outlets 20, 21 are connected with the low-pressure connection T. The two working outlets 18, 19, however, are blocked. In all three positions b, c, d mentioned until now, a pressure inlet 22 of the control valve 8 is blocked. The pressure inlet 22 is connected with the outlet of the compensation valve 11.

In a lifting position e the valve slide 9 is displaced so that the first working connection 18 and the first load-sensing outlet 20 are connected with the pressure inlet 22. The second pressure outlet 19 and the second load-sensing outlet 21 are connected with the low-pressure connection T. Pressurised hydraulic fluid is then supplied to the lifting connection A and reaches the pressure chamber 5 via the non-return valve 16. The piston 3 moves to the right. This is so to speak a normal operation mode.

In a lowering position a, however, the second working outlet 19 is connected with the pressure inlet 22, while the first working outlet 18 and the first load sensing outlet 20 are connected with the low-pressure connection T.

The second load-sensing outlet 21 is connected with an outlet 23 of a pressure divider, which is formed by two throttles 24, 25. The throttle 25 is located between the outlet 23 and the low-pressure connection T. The throttle 24 is located between the outlet 23 and the pressure inlet 22. The throttle 24 can be a constant throttle, whose flow resistance is independent of the position of the valve slide, whereas the flow resistance of the throttle 25 is variable by means of adjustments of the valve slide 9. Via a bleed 26 and a shuttle valve 27 the second load sensing outlet 21 is connected with the control pipe 14. Further, the second load sensing outlet 21 is connected with the load sensing connection LS of the supply connection arrangement 7 via a second shuttle valve 28 connected in series with the shuttle valve 27.

The first shuttle valve 27 is connected with the first load sensing outlet 20 via a bleed 26*a*.

The second load sensing outlet 21 is connected with an inlet of a selection device 29. Also the second working outlet 19 is connected with this selection device. The selection device 29 has a non-return valve 30 in the pipe connected with the second working outlet 19, so that the larger of the two pressures at the second working outlet 19 and the second load sensing outlet 21 is always available at the outlet 31.

This has the following effect: When the valve slide 9 is displaced to its lowering position a, the lowering outlet B is supplied with pressure. At the same time, the pressure at the lowering outlet B opens the load-retaining valve 15, so that pressurised hydraulic fluid can escape from the pressure chamber 5. The compensation valve 11 is controlled in two different manners, again depending on the external conditions. This is explained by means of the following example:

Initially, the pressure at the second load-sensing outlet 21 is larger than the pressure at the second working outlet 19. The reason is that at the beginning of its movement the valve slide 9 causes a relatively large throttling effect with the control valve 8. In this case, the pressure at the second working outlet 19 changes proportionally with the movement of the valve slide 9. This is shown as a section P1 in FIG. 2. In this area the control 1 works as a pressure control. However, as soon as a further movement of the valve slide 9 causes a reduction of the throttling effect between the valve slide 9 and the housing of the control valve 8, and the pressure at the second working outlet 19 increases over the pressure at the second load-sensing outlet 21, this pressure is used for controlling the compensation valve 11 and the control valve 8 works as a flow control valve, that is, the flow is now set in dependence of the position of the valve slide 9 in the control valve 8. The pressure, however, is determined by the consumer 2. The upper limit is fixed by an overpressure valve 32. A corresponding overpressure valve 32' is also mounted at the other working connection A.

When the throttle 24 between the pressure inlet 22 and the outlet 23 is also made to be variable, that is, changes with the position of the valve slide 9, this result in the lower ramp 33 shown in FIG. 2, which shows the minimum pressure of the control valve in dependence of the deflection x of the slide. At the top in FIG. 2 is shown a hybrid pressure H, that is, a pressure which is combined partly by the pressure control and partly by the flow control. The area "FC control" shows that here only the flow is controlled. The pressure adjusts automatically. When the external conditions are different, also other sequences of the pressure and flow control can occur.

In a manner known per se, a pilot-controlled stop valve 34 is also allocated to the lowering connection B.

Figure 4A:
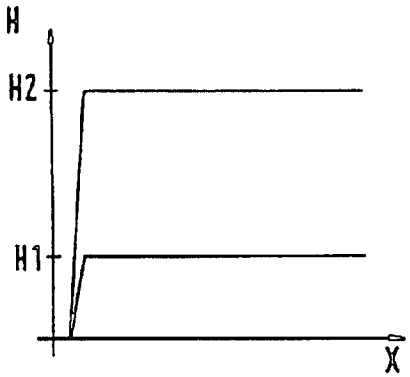
FIG. 4 a simplified view of a further embodiment of the hydraulic control.
Figure 4:
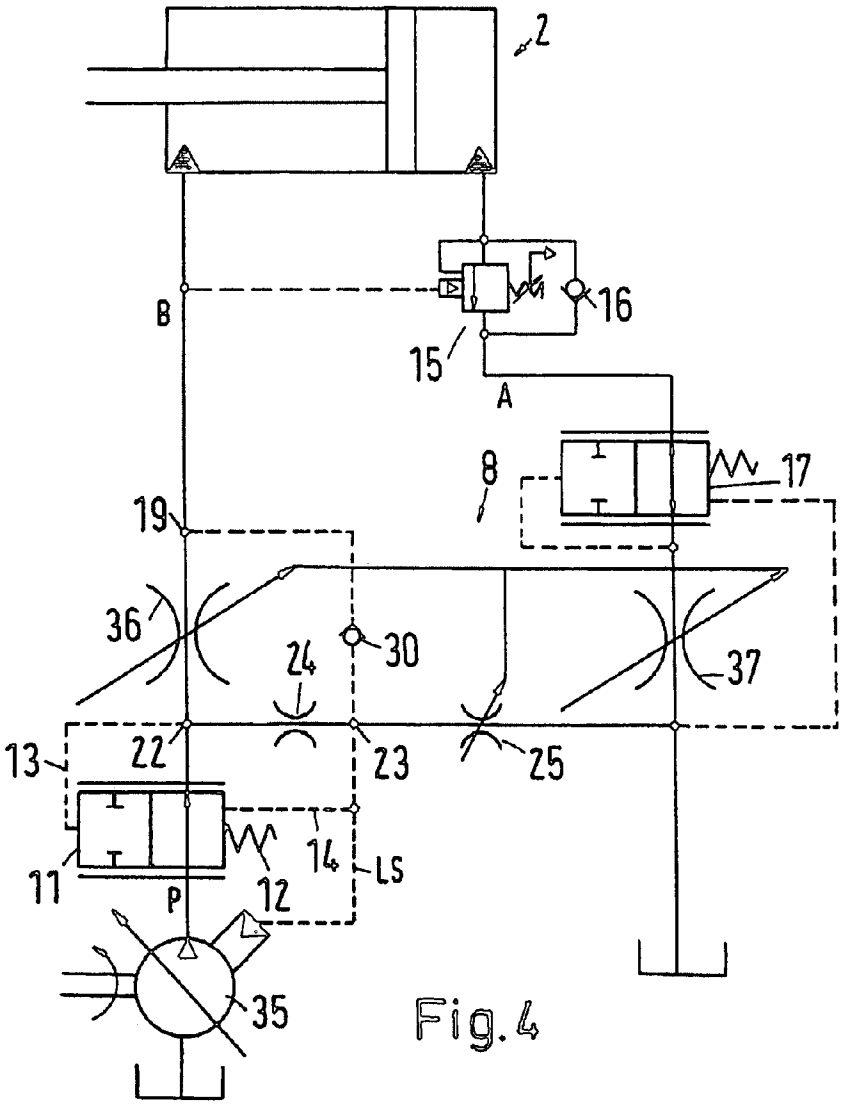

By means of FIG. 4, the mode of functioning shall be explained once again. Same parts are provided with the same reference numbers. Further shown is a variable pump 35, which is controlled via the load-sensing connection LS. The control valve 8 is here merely symbolised by two "large" throttles 36, 37 and the "small" throttle 25 as well as the throttle 24. The large throttles 36, 37 and the small throttle 25 are adjustable in dependence of the position of the valve slide 9 in the control valve 8.

When the valve slide 9 is displaced in the control valve 8, the throttles 36, 37 open and the throttle 25 closes. This leads to the increasing curve for the minimum pressure shown in FIG. 2. When the throttle 25 opens, a falling curve occurs. When the throttle 36 is still slightly open, that is, provides a large resistance, then, in dependence of the external conditions, that is, the other pressures in the system, for example the pressure at the second working outlet 19 is smaller than the pressure at the pressure inlet 22. Over the fixed throttle 24 only a small pressure drop occurs, as at the beginning of the movement of the valve slide 9 the variable throttle 25 is only slightly opened. Accordingly, the pressure at the outlet 23 is higher than the pressure at the second working outlet 19, and the non-return valve 30, which can, as shown, also be located in the valve slide 9, remains closed. Thus, the compensation valve 11 is controlled by the pressure difference between the pressure inlet 22 and the outlet 23. The pressure at the second working outlet 19 is then proportional to the displacement of the valve slide 9. The pressure is dimensioned so that, at least when it has reached its maximum value, it is sufficient to open the load retaining valve 15. A higher pressure is not required to open the load retaining valve 15. In this area the valve slide is moved by approximately 1 to 2 mm.

When, now, the throttling resistance of the throttle 36 further decreases, the pressure at the second working outlet 19 increases until it exceeds the pressure at the outlet 23. In this case, the non-return valve 30 opens, that is, the selection device 29 switches from the pressure control to the flow control. As soon as the non-return valve 30 has opened, the flow to the consumer 2 is determined by the position of the valve slide 9. The pressure, however, is determined by the consumer. In this area the valve slide is moved by a further 3 to 4 mm.

This gives an extremely energy-saving operation. A corresponding operation diagram is shown in FIG. 4*a*. At least a minimum pressure H1 is reached. This minimum pressure is defined by the pressure division between the throttles 24 and 25. A maximum pressure H2 is limited by the overpressure valve 32. Between H1 and H2 the pressure through the consumer 2 is determined.

Figure 5A:
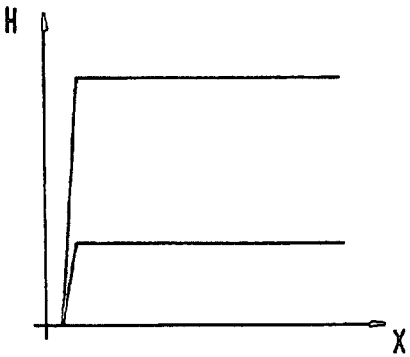
FIG. 5 an embodiment modified in relation to FIG. 4.
Figure 5:
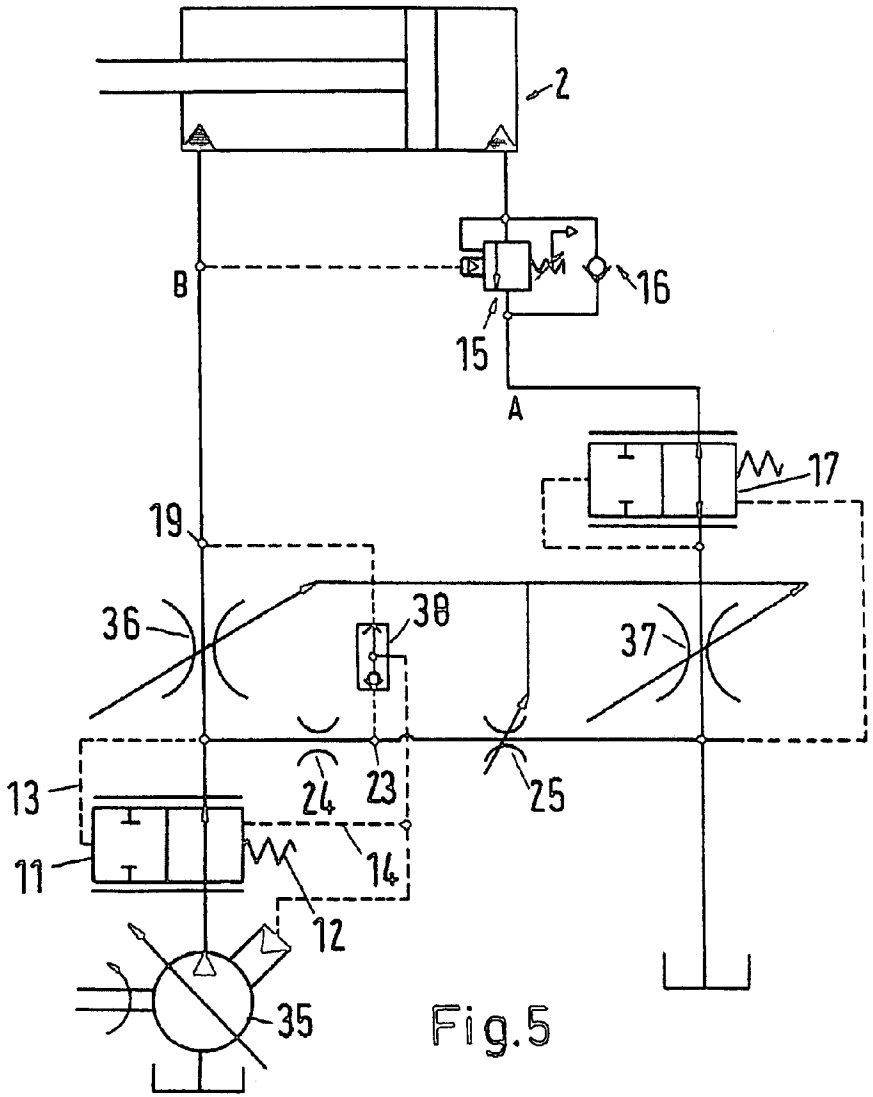

FIG. 5 shows a modified embodiment. Same elements have the same reference numbers. The non-return valve 30 is replaced by a shuttle valve 38, whose one inlet is connected with the second working outlet 19 and whose other inlet is connected with the outlet 23. As can be seen from FIG. 5*a*, practically the same operation behaviour occurs here. The shuttle valve 38 passes on the higher of the two pressures from the second working outlet 19 and the outlet 23 to the compensation valve 11.

If required, also the shuttle valve 38 can be integrated in the valve slide 9.

Figure 6A:
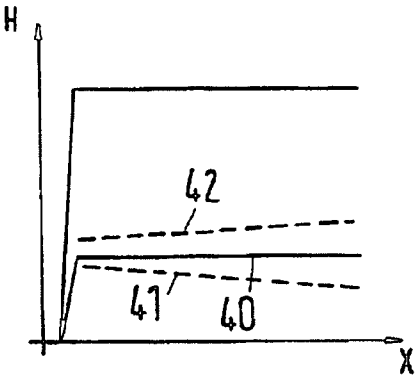
FIG. 6 an embodiment modified in relation to FIG. 4.
Figure 6:
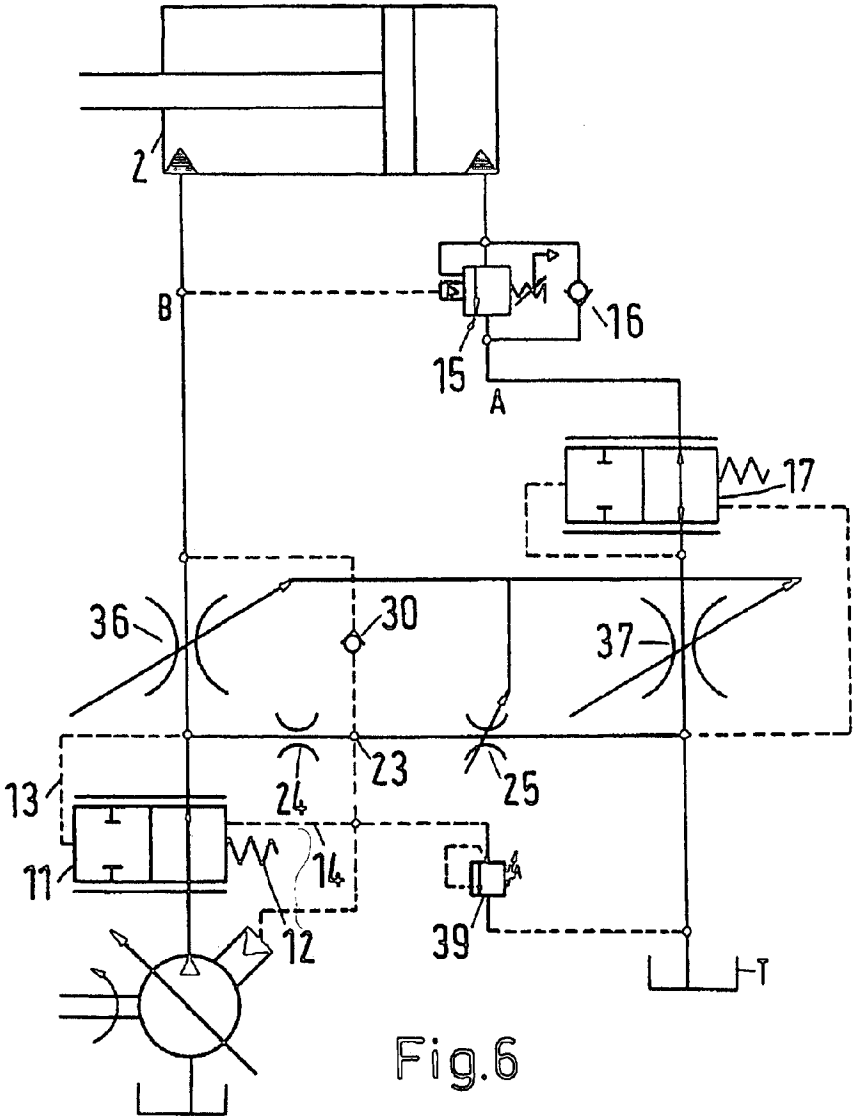

FIG. 6 is a schematic view of an embodiment, which substantially corresponds to the embodiment in FIG. 4. Here, the control pipe 14 is not only connected with the outlet 23, but additionally with a relief valve 39, which opens in the direction of the tank T. The relief is set in dependence of the consumer 2. As shown in FIG. 6*a*, this causes a minimum pressure curve 40 in the flow control area, which can be displaced between two limits 41, 42.

In all three embodiments the pressure during flow control is determined by the consumer 2. When the pressure supplied by the pressure control is too small to move the consumer, for example a load, the flow control takes over.

During the pressure control a minimum pressure occurs, which is determined by the throttle 24. This minimum pressure is set so that it is sufficient to open the load-retaining valve 15. One possibility of reducing this pressure at the lowering connection B will be discussed below in connection with FIG. 7.

In FIG. 1 the control is designed so that it can activate a motor for lifting a load. Accordingly, it is sufficient for the selection device 29 to have a non-return valve 30 only for the lowering connection B.

FIG. 3 shows a control 1, which is meant for driving a consumer 2, which can be activated in both directions and which can also provide a negative load in both directions, for example during a pushing operation in connection with forward or backward driving of a rotary motor driving a vehicle.

The same parts have the same reference numbers as in FIG. 1.

The most essential difference in relation to FIG. 1 is that a non-return valve 30, 30' is now provided for each of the two working outlets 18, 19, so that the compensation valve 11 can cause both a pressure control of the control valve 8 and a flow control in each movement direction. Accordingly, also a pressure divider with two throttles 24', 25' and an outlet 23' are provided for the second working outlet A, the outlet 23' being connected with the bleed 26*a*, when the valve slide 9 is moved to the position E. The two blocking positions b, d are not provided here.

When the valve slide 9 is in the position e, the non-return valve 30' in a manner of speaking decides, if the pressure at the first working outlet 18 or at the first load-sensing outlet 20 is higher, and should be used for controlling the compensation valve 11 via the control pipe 14.

Figure 7:
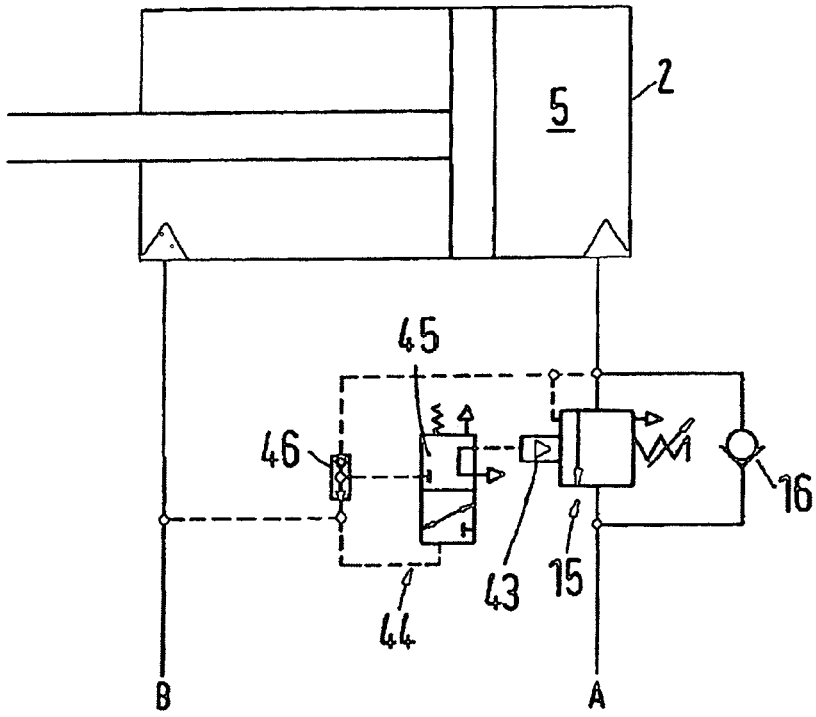
FIG. 7 a schematic view of a consumer with a load-retaining valve.

When, now, only the lowest possible pressure always rules at the lowering connection B, it could of course be difficult to open the load-retaining valve 15. Means for this are shown in FIG. 7.

The load-retaining valve 15 has a control inlet 43, which is connected with a pilot control device 44. The pilot control device has a slide 45, which can be displaced under the effect of a pressure at the lowering connection B. In the shown, non-displaced position the control inlet 43 of the load-retaining valve 15 is practically short-circuited or connected with the low-pressure connection T.

When, now, the pressure at the lowering connection B increases to a predetermined value, the slide 45 is displaced and connects the pressure chamber 5 with the control inlet 43 via a shuttle valve 46. In this case, the load-retaining valve 15 is opened. At the same time, only small pressures are required at the lowering connection B.

Figure 8:
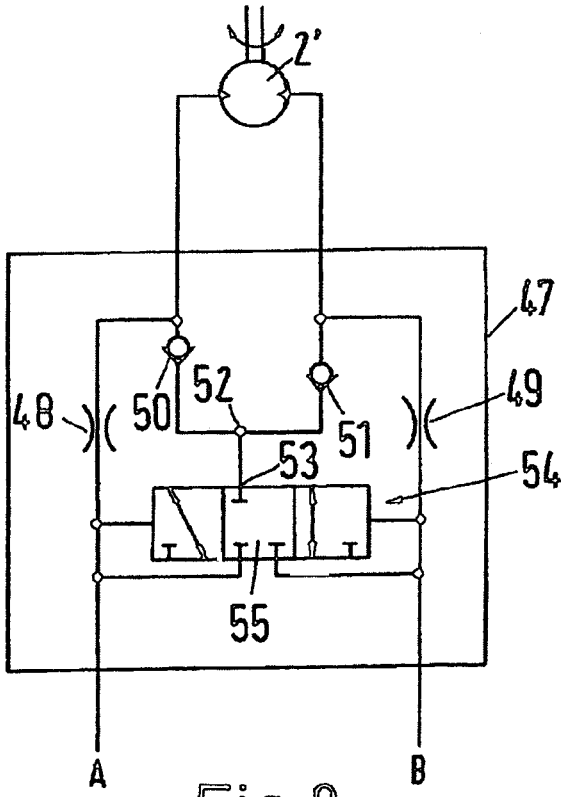
FIG. 8 a schematic view of an anti-cavitation device.

In a transmission drive 2' the pushing operation requires a refilling of hydraulic fluid to prevent cavitation. To enable this refilling at low pressures, FIG. 8 shows an anti-cavitation device 47, which can be connected with the two working connections A, B. Of course, further elements can be located between the anti-cavitation device 47 and the control 1, for example the load-retaining valve 15 shown.

By means of throttles 48, 49 resistances are shown which can occur because of valve characteristics in a valve block, which is not shown in detail, with which the drive 2' is connected.

The drive 2' is connected with both working connections A, B. Further, it is connected with a common supply point 52 via two non-return valves 50, 51. In this connection, the non-return valves 50, 51 open in the direction of the drive 2'.

The supply point 52 is connected with the outlet 53 of an anti-cavitation valve 54. The anti-cavitation valve 54 has a slide 55, which is acted upon by a control pressure from both working connections A, B. If the pressure at the working connection A is larger than the pressure at the working connection B, the slide 55 is displaced so that the working connection B is connected with the outlet 53. The drive 2' can then suck hydraulic fluid with lower pressure from the working connection B. This working connection will usually be connected with the tank.

In the opposite case, the pressure at the working connection B pushes the slide 55 so that the outlet 53 is connected with the working connection A, and the drive 2' can then suck hydraulic fluid with lower pressure from the working connection A.

As the supply takes place after the throttles 48, 49 and thus occurs with relatively small resistances, only a relatively low pressure is required for the refilling. When until now approximately 50 bar have been required for the refilling to consider the throttling losses at the throttles 48, 49 (which are parasite losses), now, for example, 30 bar will be sufficient.

With the control, a load is possible, which is smaller than a set value of, for example, 30 bar. Over this load there is then a control according to the load level, which is specified by the consumer, in other words, a flow control.

The control permits a meter-in function or a meter-out function, respectively, the system itself selecting the possibility to be used.

With negative loads, a transmission drive 2' can always provide a positive pressure at the inlet to protect against cavitation. In a cylinder application (FIG. 1) is can be ensured that by means of the defined minimum pressure the load-retaining valve is rendered non-functional, that is, can be opened, when the load is negative. Also here there will be practically no cavitation.

While the present invention has been illustrated and described with respect to a particular embodiment thereof, it should be appreciated by those of ordinary skill in the art that various modifications to this invention may be made without departing from the spirit and scope of the present invention.

The invention claimed is:

1. A hydraulic control comprising:

a supply connection arrangement having a high-pressure connection and a low-pressure connection;

a working connection arrangement having two working connections connectable with a consumer;

a control valve with a valve element between the supply connection arrangement and the working connection arrangement; and a compensation valve, which is located between the high-pressure connection and the control valve and is acted upon in the closing direction by a pressure between the compensation valve and the control valve;

wherein in the opening direction the compensation valve is acted upon by a pressure of a selection device, which optionally supplies the compensation valve with a pressure control pressure or a flow control pressure; and wherein the selection device supplies the higher of the pressures, pressure control pressure and flow control pressure, to the compensation valve.

2. The hydraulic control according to claim 1, wherein an actuation of the control valve from a predetermined position will make the selection device pass on firstly the pressure control pressure and secondly the flow control pressure to the compensation valve.

3. The hydraulic control according to claim 1, wherein the selection device has a non-return valve, which opens in the direction of the compensation valve.

4. The hydraulic control according to claim 3, wherein the non-return valve is located in the valve element of the control valve.

5. The hydraulic control according to claim 1, wherein the selection device comprises a shuttle valve.

6. The hydraulic control according to claim 1, wherein a load-retaining valve is located at least one working connection, which load retaining valve can be opened via a pilot control device by the pressure at the other working connection.

7. The hydraulic control according to claim 6, wherein the pilot control device has a pilot valve element controllable by the pressure at the other working connection, said pilot control device making in the controlled state a connection from one working connection to a control inlet of the load-retaining valve and interrupting it in the non-controlled state.

8. The hydraulic control according to claim 1, wherein the working connection arrangement is connected with an anti-cavitation device, which has an anti-cavitation valve with an anti-cavitation valve element, which is displaceable by means of a pressure at a working connection and creates a connection between a consumer connection and the other working connection.

9. The hydraulic control according to claim 1, wherein the outlet of the selection device is connected with a pressure limitation valve.

10. The hydraulic control according to claim 1, wherein the selection device is on the one side connected with a working pipe located between the control valve and a working connection and on the other side with a control pipe connected with a load-sensing pipe.

11. The hydraulic control according to claim 10, wherein the control pipe is connected with an outlet of a pressure divider, which is located between the compensation valve and the low-pressure connection.

12. The hydraulic control according to claim 11, wherein the pressure divider has at least two throttles, of which one can be adjusted by the valve element of the control valve.

13. The hydraulic control according to claim 11, wherein the pressure divider has two throttles, which can both be adjusted by the valve element of the control valve.

14. A method of controlling a hydraulic consumer, the method comprising:

controlling the consumer with a control valve in a pressure control operation mode; and alternatively controlling the consumer with the control valve in a flow control operation mode;

wherein the switching between the pressure control operation mode and the flow control mode occurs automatically in dependence of a higher of a pressure control pressure and a flow control pressure.

15. A hydraulic control comprising:

a supply connection arrangement having a high-pressure connection and a low-pressure connection;

a working connection arrangement having two working connections connectable with a consumer;

a control valve with a valve element between the supply connection arrangement and the working connection arrangement; and a compensation valve, which is located between the high-pressure connection and the control valve and is acted upon in the closing direction by a pressure between the compensation valve and the control valve;

wherein in the opening direction the compensation valve is acted upon by a pressure of a selection device, which optionally supplies the compensation valve with a pressure control pressure or a flow control pressure; and wherein the selection device is on the one side connected with a working pipe located between the control valve and a working connection and on the other side with a control pipe connected with a load-sensing pipe.

16. The hydraulic control according to claim 15, wherein the control pipe is connected with an outlet of a pressure divider, which is located between the compensation valve and the low-pressure connection.

17. The hydraulic control according to claim 16, wherein the pressure divider has at least two throttles, of which one can be adjusted by the valve element of the control valve.

18. The hydraulic control according to claim 16, wherein the pressure divider has two throttles, which can both be adjusted by the valve element of the control valve.

* * * * *